US006615736B2

(12) United States Patent
Duparc et al.

(10) Patent No.: US 6,615,736 B2
(45) Date of Patent: Sep. 9, 2003

(54) PRIMING DEVICE FOR AN EXPLOSIVE CHARGE AND SHAPED CHARGE INCORPORATING SUCH A PRIMING DEVICE

(75) Inventors: Jean-Paul Duparc, Bourges (FR); Michel Vives, Saint-Ambroix (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 10/013,458

(22) Filed: Dec. 13, 2001

(65) Prior Publication Data

US 2003/0140812 A1 Jul. 31, 2003

(30) Foreign Application Priority Data

Dec. 13, 2000 (FR) ..... 00 16352

(51) Int. Cl.[7] ..... F42B 1/00
(52) U.S. Cl. ..... 102/306
(58) Field of Search ..... 102/275.2, 275.6, 102/275.11, 306, 307

(56) References Cited

U.S. PATENT DOCUMENTS 3,626,850 A 12/1971 Davis ..... 102/24
3,721,192 A * 3/1973 McEwan et al. ..... 102/306
4,754,704 A * 7/1988 Lubbers ..... 102/275.11
4,892,039 A 1/1990 Emerson et al. ..... 102/476
5,159,145 A 10/1992 Carisella et al. ..... 102/222
5,631,440 A * 5/1997 Thureson et al. ..... 102/275.7
5,756,925 A * 5/1998 Frank et al. ..... 102/202.7
5,780,764 A * 7/1998 Welch et al. ..... 102/275.6
6,349,649 B1 * 2/2002 Jacoby et al. ..... 102/307

FOREIGN PATENT DOCUMENTS

EP 0 471 622 A1 2/1992

* cited by examiner

*Primary Examiner*—Peter A. Nelson
(74) *Attorney, Agent, or Firm*—Oliff & Berridge, PLC

(57) ABSTRACT

The invention relates to safety priming device for an explosive charge, notably a shaped charge, comprising a pyrotechnic igniter and at least one igniting relay placed between the igniter and an explosive load.

This priming device is characterized in that the igniting relay comprises means enabling the detonation wave produced by the igniter or igniters to be re-centered along the charge axis, said means comprising a confinement block having a bore converging between an external face positioned beside the igniter or igniters and an inner face positioned beside the explosive load, said bore filled with a relay explosive, the confinement block comprising means to prevent the propagation of a shock wave axially through the confinement block between the igniter or igniters and the explosive load.

16 Claims, 3 Drawing Sheets

PRIMING DEVICE FOR AN EXPLOSIVE CHARGE AND SHAPED CHARGE INCORPORATING SUCH A PRIMING DEVICE

BACKGROUND OF THE INVENTION

The technical scope of the invention is that of priming devices for an explosive charge, and notably for a shaped charge.

Known priming devices generally comprise at least one pyrotechnic igniter and at least one igniting relay placed between the igniter and an explosive load.

One of the problems encountered with known priming devices is the difficulty of ensuring the accurate centering of the pyrotechnic igniter with respect to the charge body.

More particularly, in the case of shaped charges, the detonation wave that is propagated in the charge must be perfectly symmetrical with respect to the charge axis.

Such a symmetry enables the optimal displacing or deformation of the shaped charge liner (slug or hollow charge). Even slight asymmetry (for example of around a few tenths of a millimeter) risks causing a reduction in effectiveness of the shaped charge.

Moreover, in the field of self-destruct charges for ballistic missiles, it is customary to include back-up priming means so as to reduce this risk of failure of the self-destruct system.

The multiplication of priming means thus raises the problem of producing a priming wave that is symmetrical and this whatever the position of the igniter being activated.

SUMMARY OF THE INVENTION

The aim of the invention is to propose a priming device that overcomes such problems and does not suffer from the drawbacks of known devices.

Thus, the priming device according to the invention ensures the ignition of an explosive charge along the charge axis whatever the position of the igniter or igniters with respect to said axis.

The invention thus makes it possible to obtain priming symmetry, using simple means.

Thus, the invention relates to a safety priming device for an explosive charge, notably a shaped charge, comprising a pyrotechnic igniter and at least one igniting relay placed between the igniter and an explosive load of the charge, wherein the igniting relay comprises means enabling the detonation wave produced by the igniter or igniters to be re-centered along the charge axis, said means comprising a confinement block having a bore converging between an external face positioned on the said having the igniter or igniters and an inner face positioned beside the explosive load, said bore filled with a relay explosive, the confinement block comprising means to prevent the propagation of a shock wave axially through the confinement block between the igniter or igniters and the explosive load.

According to a first embodiment of the invention, the confinement block may be made of an organic material having acoustic impedance that is less than $15.10^6$ kg/m$^2$s, this material constituting means to prevent the propagation of a shock wave through the confinement block.

According to a second embodiment of the invention, the confinement block may incorporate at least one collar that will be placed in the vicinity of the igniter or igniters and which will be followed by a free space surrounding the block, said free space constituting means to prevent the propagation of a shock wave axially through the confinement block.

This free space may be formed by a cylindrical groove delimited by two collars.

The bore in the confinement block may incorporate at least one conical part having a half-angle at the apex of between 10 and 25°, the small diameter of the cone being of between 2 and 5 mm and the large diameter of the cone being of between 13 and 30 mm.

The igniting relay may comprise a first layer of relay explosive applied to the confinement block and placed between the igniter or igniters and the confinement block.

The confinement block will be generally cylindrically shaped and arranged in a body.

The first relay layer may be of a thickness of at least 2 mm.

The first layer of relay explosive may be ring-shaped or else may be in the shape of a substantially rectangular tongue.

Advantageously, the device may comprise at least two pyrotechnic igniters placed at a distance from the charge axis.

A further subject of the invention is a shaped charge incorporating a safety priming device having at least two igniters and having the same performances whichever igniter is activated.

Such a charge may be used notably to ensure the destruction function during the trajectory for ballistic projectiles or for their payload.

In this case, this charge may advantageously be an explosively-formed charge.

BRIEF DESCRIPTION OF THE DRAWINGS

The invention will become more apparent after reading the following description of the different embodiments, such description being made with reference to the appended drawings, in which.

DETAILED DESCRIPTION OF THE PREFERRED EMBODIMENTS

Figure 1:
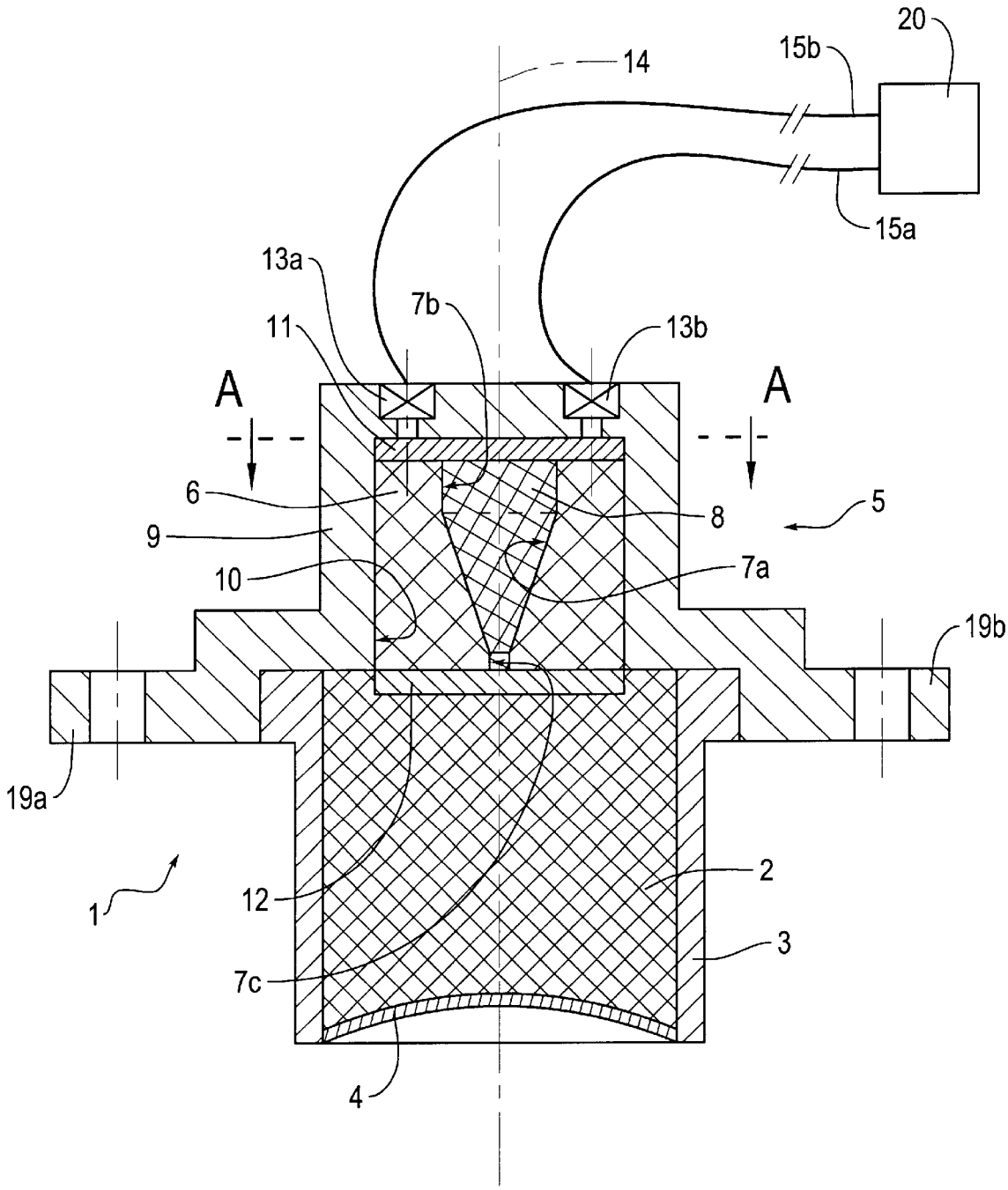
FIG. 1 is a longitudinal section view of a shaped charge fitted with a priming device according to a first embodiment of the invention.

With reference to FIG. 1, a shaped charge 1 (in this case an explosively-formed charge) comprises an explosive load 2 placed in a cylindrical casing 3 screwed to a body 9 having fastening lugs 19*a*, 19*b*.

A cup-shaped liner 4 is applied to the explosive load 2. A priming device 5 allows the explosive load 2 to be ignited.

In accordance with the invention, the priming device 5 comprises a confinement block 6 placed in a cylindrical cavity 10 in a body 9.

According to this first embodiment, the block 6 is made of an organic material having acoustic impedance less than $15.10^6$ kg/m$^2$s. The block 6 may, for example, be made of polyacetal.

The block 6 has a bore 7 that comprises a conical part 7*a* extended by two cylindrical parts 7*b* and 7*c*.

The bore 7 is filled with a relay explosive 8.

The priming device 5 also comprises a first layer 11 and a second layer 12 of relay explosive.

These two relay layers 11 and 12 are arranged on the upper and lower faces of the confinement block 6.

The second relay layer 12 is, in this case, housed in a cavity made in the explosive load 2. It might also be simply applied to an upper surface of the explosive load 2. It would also be possible for no second relay layer to be provided and for the block 6 to be applied directly onto the load 2.

The first relay layer 11 is arranged at the bottom of the cavity 10 in the body 9. It communicates with two pyrotechnic igniters 13*a*, 13*b* placed symmetrically on either side of the charge axis 14.

Here these igniters are electrically-ignited primers and are controlled by an ignition device 20 placed at a distance and connected to the igniters 13*a*, 13*b* by conductors 15*a*, 15*b*. The igniters may also be formed by pyrotechnic transmission lines, for example detonating lines.

The conical part 7*a* of the bore 7 converges between an outer face of the block 6 positioned beside the igniters 13*a*, 13*b* and an inner face of the bock positioned beside the explosive load 2. This conical part 7 has a half-angle at the apex that is of between 10 and 25°, the small diameter of the cone being of between 2 and 5 mm and the large diameter of the cone being of between 13 and 30 mm.

Relay layers 11 and 12 may be made of composite explosive cut out of plates.

The relay composition 8 filling the bore 7 will be cyclonite, for example. This composition 8 will be put in place by compression.

This priming device operates as follows.

When the charge 1 is required to be fired, the ignition device 20 sends a firing order to both igniters 13*a*, 13*b* simultaneously. These ignite the first relay layer 11 which in turn ignites the relay composition 8 placed in the bore 7 of the bore 6.

Because of the convergence of the conical part 7*a* of this bore, the shock wave that is propagating in the composition 8 also converges towards the second relay layer 12 which is ignited practically along the axis 14 of the charge 1.

The second relay layer in turn ignites the explosive load 2, causing the projectile to be formed by the liner 4.

If only one of the igniters 13*a*, 13*b* functions, the other presenting a failure, the first layer 11 is ignited out-of-line with the axis. It nevertheless ignites the relay composition 8 and the convergence of the conical bore 7*a* ensures the re-centering of the shock wave and thus the faultless ignition of the second relay layer 12, and thus of the explosive load 2.

So as to avoid the inadvertent ignition of the second relay layer 12 or of the load 2 directly by the shock wave through the material of the confinement block 6, means must be provided to prevent such a propagation.

According to this first embodiment, the block 6 is made of a material enabling such a propagation to be absorbed. The block 6 will thus be made of an organic material having an acoustic impedance of less than $15.10^6$ kg/m$^2$s.

Other means can be used to prevent the direct ignition of the relay layer 12 or the explosive 2 by the propagation of the shock wave through the material of the confinement block 6.

Figure 2:
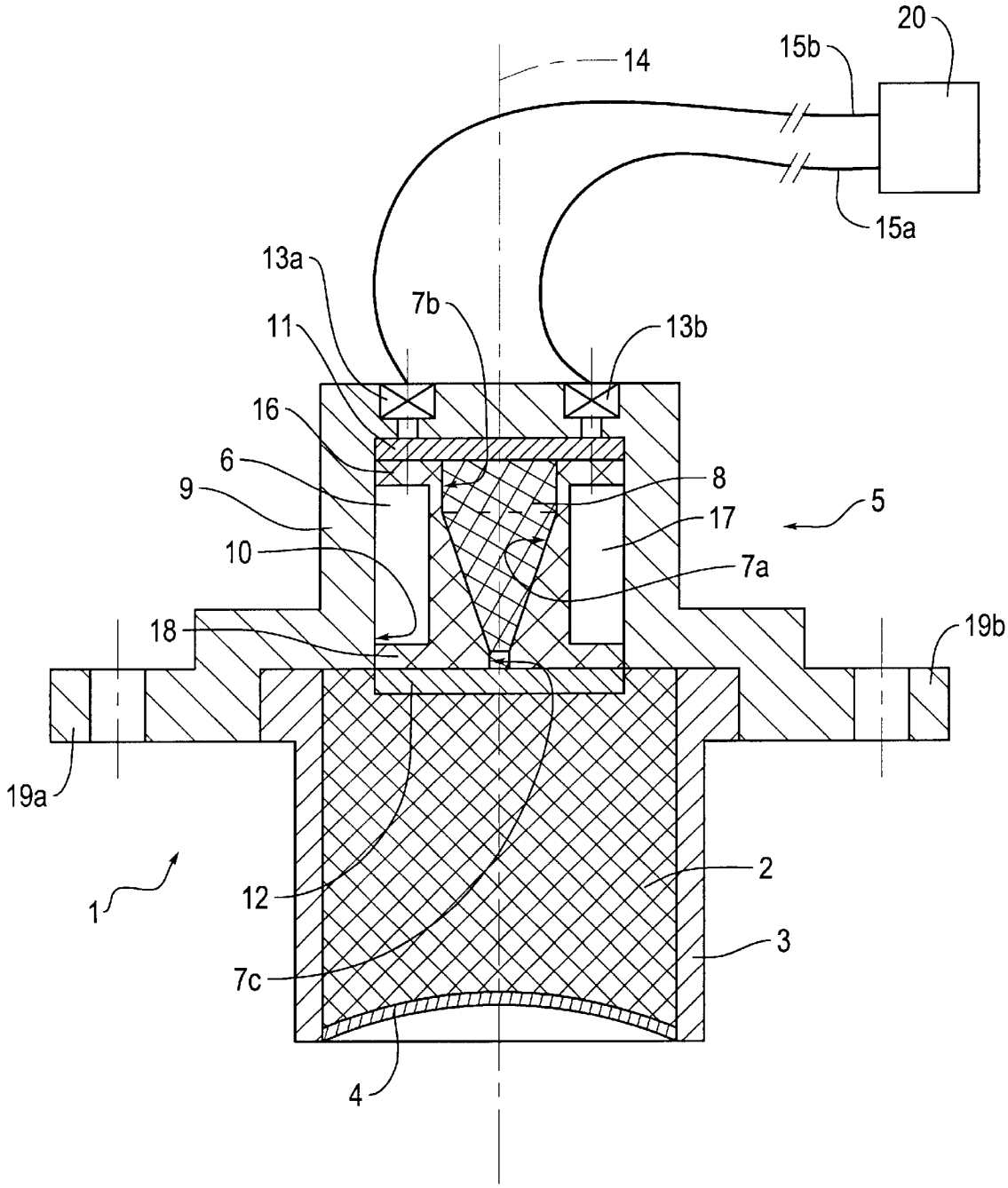
FIG. 2 is a longitudinal section view of a shaped charge fitted with a priming device according to a second embodiment of the invention.

FIG. 2 thus shows a second embodiment of the invention that differs from the first one in that the confinement block 6 incorporates a collar 16 placed at the upper face of the block and onto which the first relay layer 11 is applied. This collar 16 is followed by a free space 17 surrounding the block 6.

A second collar 18 allows the block 6 to be positioned in the bore 10. Thus, the free space 17 is formed by a cylindrical groove arranged in the block 6 and delimited by the two collars 16 and 18.

The free space 17 constitutes means to prevent the propagation of a shock wave axially through the confinement block 6. Indeed, the shock received by the collar 16 further to the ignition of the first relay layer 11 is not able to propagate directly to the second collar 18.

The relay composition 8 is ignited as in the previous embodiment and the convergent profile of the bore 7*a* ensures the centering of the shock wave and the axial ignition of the second relay layer 12 and thus of the explosive load.

Once again, this axial ignition is ensured even if only one of the igniters 13*a*, 13*b* functions.

Thanks to the presence of the free space 17, it is possible for the confinement block 6 to be made of metal, for example an aluminum alloy.

The first layer 11 of relay explosive shown in FIGS. 1 and 2 has revolving symmetry.

It is possible for a first relay layer of a different shape to be implemented.

Figure 3:
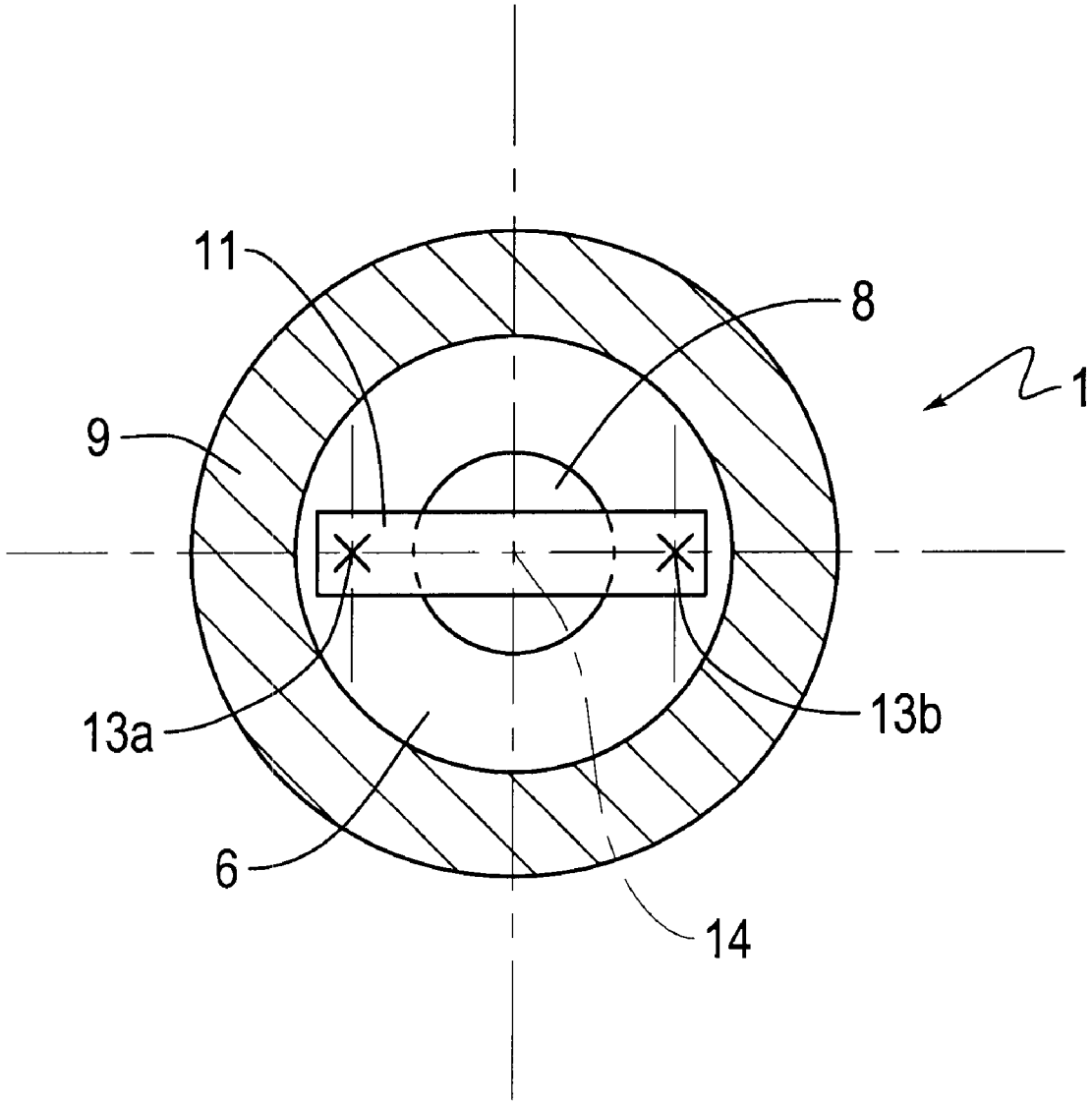
FIG. 3 is a transversal section view of a shaped charge according to a third embodiment of the invention.

FIG. 3 thus shows a top view and section view of a priming device according to a variant embodiment in which the first layer 11 is in the shape of a substantially rectangular tongue passing through the axis 14 of the charge.

This view is a section made along a plane referenced AA in FIG. 1. The latter Figure has been described previously with reference to an embodiment in which the first relay layer 11 is ring-shaped. This Figure may also be associated with this third embodiment where the first layer is a tongue.

The igniters 13*a*, 13*b* (the position of only one of which is shown) are arranged on either side of axis 14, each at one end of the relay layer 11.

The relay composition 8 arranged in the confinement block 6 is ignited by means of the relay layer 11 whichever igniter is primed.

As in the previous example, the convergent profile of the bore 7*a* ensures the centering of the shock wave and the axial ignition of the second relay layer 12 and of the explosive load.

The block 6 can be either structured according to FIG. 1 (organic material) or to FIG. 2 (peripheral groove) regardless.

Other variants are possible without departing from the scope of the invention.

Thus, the device according to the invention may implement only one igniter that is out-of-line with respect to axis 14 of the charge. Such a configuration makes it easier to integrate a charge in a given projectile. Indeed, thanks to the invention, it is no longer necessary for the igniter to be positioned axially with respect to the charge.

It is also possible for a first relay layer 11 and the relay explosive placed in the confinement block to be made in the form of a single mass of explosive, implemented for example by compression. The explosive mass will comprise a conical lower part and a disk or tongue-shaped upper part. In this case, the confinement block will be given a suitably shaped upper face enabling it to receive the disk or tongue-shaped relay explosive part.

It is naturally possible for the priming device according to the invention to be implemented with other types of explosive charges: hollow charges, splinter-generating charges, etc.

The shaped charge proposed by the invention is fitted with at least two igniters. Greater reliability is thereby ensured in the event of using the charge for the function of destroying a ballistic projectile such as a rocket or missile during its trajectory or else for the destruction of the charge carried on-board this projectile. This improved reliability is due to the backed-up igniters, of which there may be more than two. This is coupled thanks to the invention to an effectiveness that is the same whatever the number and position of the igniters primed, the priming device ensuring in any case the ignition of the explosive load along the axis of symmetry 14 of the charge. The igniters are shown in the Figures having orientations substantially parallel to one another and to the charge axis. These igniters may also be placed at a different orientation making an angle with the charge axis.

What is claimed is:

1. A safety priming device for an explosive charge, notably a shaped charge, comprising a pyrotechnic igniter and at least one igniting relay placed between said igniter and an explosive load of said charge, wherein said igniting relay comprises means enabling the detonation wave produced by said igniter or igniters to be re-centered along the axis of said charge, said means comprising a confinement block having a bore converging between an external face positioned beside the igniter or igniters and an inner face positioned beside said explosive load, said bore being filled with a relay explosive, said confinement block comprising means to prevent the propagation of a shock wave axially through its block between said igniter or igniters and said explosive load.

2. A priming device according to claim 1, wherein said confinement block is made of an organic material having an acoustic impedance that is less than $15.10^6$ kg/m$^2$s, this material constituting means to prevent the propagation of a shock wave through said confinement block.

3. A priming device according to claim 2, wherein said confinement block incorporates at least one collar that is placed in the vicinity of the igniter or igniters and which is followed by a free space surrounding said block, said free space constituting means to prevent the propagation of a shock wave axially through said confinement block.

4. A priming device according to claim 3, wherein said free space is formed by a cylindrical groove delimited by two collars.

5. A priming device according to claim 1, wherein said bore in said confinement block incorporates at least one conical part having a half-angle at the apex of between 10 and 25°, the small diameter of said conical part being of between 2 and 5 mm and the large diameter of said conical part being of between 13 and 30 mm.

6. A priming device according to claim 1, wherein said igniting relay comprises a first layer of relay explosive applied to the confinement block and placed between said igniter or igniters and the explosive of said confinement block.

7. A priming device according to claim 3, wherein said confinement block is globally cylindrically shaped and arranged in a body.

8. A priming device according to claim 6, wherein said first relay layer is of a thickness of at least 2 mm.

9. A priming device according to claim 7, wherein said first relay layer is of a thickness of at least 2 mm.

10. A priming device according to claim 6, wherein said first layer of relay explosive is ring-shaped.

11. A priming device according to claim 6, wherein said first layer of relay explosive is in the shape of a substantially rectangular tongue.

12. A priming device according to claim 1, wherein it comprises at least two pyrotechnic igniters placed at a distance from the charge axis.

13. A priming device according to claim 5, wherein it comprises at least two pyrotechnic igniters placed at a distance from the charge axis.

14. A priming device according to claim 6, wherein it comprises at least two pyrotechnic igniters placed at a distance from the charge axis.

15. A shaped charge incorporating a priming device according to claim 11.

16. A shaped charge according to claim 12, wherein said charge is an explosively-formed charge.

* * * * *